US012523006B2

(12) United States Patent
Lim

(10) Patent No.: US 12,523,006 B2
(45) Date of Patent: Jan. 13, 2026

(54) VIBRATORY RIPPER

(71) Applicant: STERLING TECHNOLOGY INC., Hwaseong-si (KR)

(72) Inventor: Wan Bin Lim, Seoul (KR)

(73) Assignee: STERLING TECHNOLOGY INC., Hwaseong-si (KR)

( * ) Notice: Subject to any disclaimer, the term of this patent is extended or adjusted under 35 U.S.C. 154(b) by 386 days.

(21) Appl. No.: 18/209,484

(22) Filed: Jun. 14, 2023

(65) Prior Publication Data

US 2024/0218630 A1 Jul. 4, 2024

(30) Foreign Application Priority Data

Jan. 4, 2023 (KR) ..... 10-2023-0001017

(51) Int. Cl.
*E02F 5/32* (2006.01)

(52) U.S. Cl.
CPC ..... *E02F 5/326* (2013.01)

(58) Field of Classification Search
CPC ..... E02F 5/326
See application file for complete search history.

(56) References Cited

U.S. PATENT DOCUMENTS

2015/0184363 A1* 7/2015 Lee ..... E02F 5/326 74/25

FOREIGN PATENT DOCUMENTS

| | | | | | |
|---|---|---|---|---|---|
| CA | 3121796 | A1 | | 6/2020 | |
| KR | 100755017 | B1 | * | 9/2007 | ..... E02F 5/326 |
| KR | 10-2009-0054513 | A | | 6/2009 | |
| KR | 20100056924 | A | * | 5/2010 | ..... E02F 5/326 |
| KR | 10-2010-0086387 | A | | 7/2010 | |
| KR | 20140095886 | A | * | 8/2014 | ..... E02F 5/326 |
| KR | 10-2020-0116823 | A | | 10/2020 | |

* cited by examiner

*Primary Examiner* — Matthew R Buck
(74) *Attorney, Agent, or Firm* — Revolution IP, PLLC

(57) ABSTRACT

A vibratory ripper includes: an external body having an inner accommodation part and comprising at least one insertion hole defined at one side thereof; a vibratory body accommodated in the accommodation part of the external body to form a vibration; and a guide roller disposed in the insertion hole to guide a vertical movement of the vibratory body.

7 Claims, 5 Drawing Sheets

VIBRATORY RIPPER

CROSS-REFERENCE TO RELATED APPLICATIONS

This U.S. non-provisional patent application claims priority under 35 U.S.C. § 119 of Korean Patent Application No. 10-2023-0001017, filed on Jan. 4, 2023, the entire contents of which are hereby incorporated by reference.

BACKGROUND

The present invention relates to a vibratory ripper.

In general, a vibratory ripper refers to heavy equipment used in various construction sites such as a road, a bridge, new construction and demolition of buildings. The vibratory ripper has an advantage of improving work efficiency because the vibratory ripper generates power much greater than manpower.

The vibratory ripper includes a driving unit such as an endless track or a wheel disposed at a lower portion of a vehicle body so as to be driven by magnetic force, a boom that is disposed on a front portion of the vehicle body and performs a bending, rotating, and lifting operation to function as with a human arm, and all sorts of tool equipment that is necessary depending on the kind of the operation and mounted on an end of the boom.

Korean Patent Publication No. 10-2009-0054513 that is the related art document discloses a vibratory ripper capable of reducing a damage of each of a vibratory unit and a vibration-proof member.

RELATED ART DOCUMENT

Patent Document (Patent document 1) Korean Patent Publication No. 10-2009-0054513

SUMMARY

The present invention relates to a vibratory ripper that effectively absorbs a vibration of a vibratory body and improves durability.

Also, the present invention may provide a guide roller that stably supports a vertical movement of the vibratory body.

Also, the present invention may effectively absorb a shock transmitted to the guide roller to extend a lifespan of a product.

Also, the present invention may effectively absorb a shock transmitted to the guide roller to extend a lifespan of a product.

Also, the present invention may easily perform maintenance of the guide roller.

An embodiment of the present invention provides a vibratory ripper including: an external body having an inner accommodation part and comprising at least one insertion hole defined at one side thereof; a vibratory body accommodated in the accommodation part of the external body to form a vibration; and a guide roller disposed in the insertion hole to guide a vertical movement of the vibratory body.

Here, the guide roller includes: a fixing plate disposed on the external body; a fixing member configured to fix the fixing plate to the external body; a roller member inserted into the external body to guide the vertical movement of the vibratory body; and a shock absorbing member disposed between the fixing plate and the external body.

In an embodiment, the fixing member may include: a coil inserted into a portion of each of a hole of the shock absorbing member and an insert hole of the external body: and a bolt inserted along a thread formed by the coil.

In an embodiment, the shock absorbing member may include a hole through which the fixing member passes and dampen a vibration applied to a bolt of the fixing member, which is caused by a vibration of the roller member.

In an embodiment, the external body may include a support structure disposed on each of upper and lower portions of the insertion hole and extending to the inside of the external body.

Here, the guide roller may further include a fixing support member disposed between the roller member and the fixing plate and fixed to the support structure.

In another embodiment, the vibratory ripper may further include: a link member configured to connect the external body and the vibratory body: a roller guide disposed at one side of the vibratory body and configured to guide the vibratory body to move vertically along the roller member while contacting the roller member: a first stopper disposed below the roller guide; and a second stopper configured to restrict a moving distance of the vibratory body while contacting the first stopper when the vibratory body moves downward.

In an embodiment, the external body may include a link hole, the link member may include a first link shaft member that rotates around the link hole, and the second stopper may be disposed on the first link shaft member.

BRIEF DESCRIPTION OF THE FIGURES

The accompanying drawings are included to provide a further understanding of the inventive concept, and are incorporated in and constitute a part of this specification. The drawings illustrate embodiments of the inventive concept and, together with the description, serve to explain principles of the inventive concept. In the drawings.

DETAILED DESCRIPTION

Figure 1:
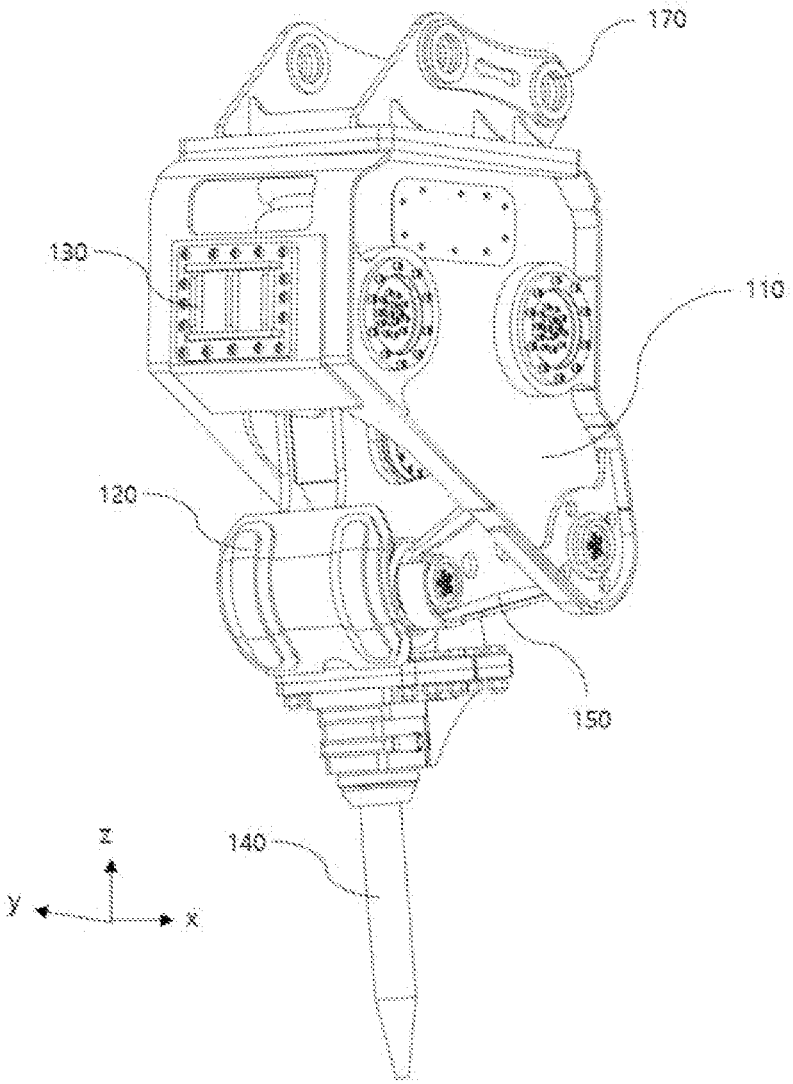
FIG. 1 is a view illustrating a vibratory ripper according to an embodiment of the present invention.

Hereinafter, exemplary embodiments of the present invention will be described below in more detail with reference to the accompanying drawings. The present invention may, however, be embodied in different forms and should not be constructed as limited to the embodiments set forth herein. These embodiments are provided so that this disclosure will be thorough and complete, and will fully convey the concept of the present invention to those skilled in the art. In the drawings, the shapes and dimensions of components are exaggerated for clarity, and like reference numerals denote like elements. Also, portions having similar function and effect may be expressed with the same or similar reference symbol throughout. Furthermore, when it is described that one comprises (or includes or has) some elements, it should be understood that it may comprise (or include or has) only those elements, or it may comprise (or include or have) other elements as well as those elements if there is no specific limitation.

A vibratory ripper 100 according to an embodiment of the present invention includes: an external body 110 having an inner accommodation part and including at least one insertion hole 111 defined at one side thereof; a vibratory body 120 accommodated in the accommodation part of the external body 110 to form a vibration; and a guide roller 130 disposed in the insertion hole 111 to guide a vertical movement of the vibratory body 120. Also, in an embodiment, the vibratory ripper 100 may further include at least one of an upper fastening member 170 disposed on the external body 110 to connect the vibratory ripper 100 to an external operating device or a vehicle, a tooth 140 connected to the vibratory body 120 and transmitting a vibration generated from the vibratory body 120 to an external object to be crushed, thereby crushing the external object to be crushed, a link member 150 connecting the external body 110 and the vibratory body 120 by using a link, and a vibration-proof member 160 disposed in the accommodation part of the external body 110 and disposed between the vibratory body 120 and the external body 110 to absorb the vibration of the vibratory body 120. Also, in another embodiment, the vibratory ripper 100 may further include at least one of a roller guide 181 disposed at one side of the vibratory body 120 and guiding the vibratory body 120 to move vertically along the roller member 133 while contacting the roller member 133: a first stopper 182 disposed below the roller guide 181; and a second stopper 183 restricting a moving distance of the vibratory body 120 while contacting the first stopper 182 when the vibratory body 120 moves downward.

The external body 110 performs a function of accommodating the vibratory body 120 in the accommodation part in the external body 110 and supporting the vibratory body 120. Also, the external body 110 performs a function of accommodating and supporting the guide roller 130.

The external body 110 may include the insertion hole 111 to which the guide roller 130 is inserted and further include a support structure 112 supporting the guide roller 130. Also, the external body 110 may further include a link hole 113 to which the link member 150 is inserted.

As the insertion hole 111 is defined in a front surface and/or a rear surface (a surface perpendicular to a Y-axis) of the external body 110, the guide roller 130 may be inserted to the insertion hole 111 at the front surface and/or the rear surface of the external body 110. According to the present invention, since the guide roller 130 may be easily mounted and demounted by inserting the guide roller 130 and fixing the guide roller 130 by using a fixing member 132 such as a bolt 132*a*, assembly and maintenance are easily performed.

The link hole 113 may be formed in both side surfaces (surfaces perpendicular to the X-axis) perpendicular to the insertion hole 111 by passing through the external body 110.

The external body 110 may include a plurality of insert holes arranged along an edge of the insertion hole 111 in a surface disposed on the edge. The fixing members 132 are inserted into the insert holes to fix the guide roller 130 to the external body 110.

As described above, the external body 110 may include the support structure 112 disposed on each of upper and lower portions of the insertion hole 111 and extending to the inside of the external body 110. The support structure 112 performs a function of supporting the guide roller 130 in the accommodation part that is an inner space of the external body 110. Also, the support structure 112 may include the insert hole. That is, the support structure 112 may support the guide roller 130 at upper and lower portions of the guide roller 130 and simultaneously fix the guide roller 130 through the bolt 132*a* (refer to FIG. 3). Through this, the support structure 112 may prevent the guide roller 130 from being deviated from a regular position and absorb a vibration to prevent the fixing member 132 of the guide roller 130 from being damaged. The support structures 112 are arranged along upper and lower edges of the insertion hole 111 in an inner surface of the external body 110 and extend as many as a length of a second member 135*b* of a roller support member 135 of the guide roller 130. In this case, the support structures 112 may not contact a first member 135*a* of the roller support member 135. Through this, the support structure 112 may support the guide roller 130 more stably and may not interfere with a rotation of the roller member 133.

Also, the external body 110 may include a plurality of link holes in a side surface (a surface perpendicular to the X-axis). The link hole is a hole into which the vibratory body 120 and the link member 150 are inserted. The vibratory body 120 and the link member 150 may be connected to external body 110 through the link hole to rotate.

As described above, the insertion hole 111 and the link hole may be defined in different surfaces. Through this, interference between the guide roller 130 and other components may be minimized when the guide roller 130 is mounted and demounted.

Although the external body 110 may be made of metal or alloy, the embodiment of the present invention is not limited thereto.

The vibratory body 120 performs a function of forming a vibration. The vibratory body 120 may include a housing and at least one eccentric member disposed in the housing. Also, the vibratory body 120 may further include a reducer disposed in the housing. The eccentric member and the reducer generate a vibration by eccentricity. Although the vibratory body 120 may be a vibratory body that is generally used in the field of the vibratory ripper 100, the embodiment of the present invention is not limited thereto.

Figure 2:
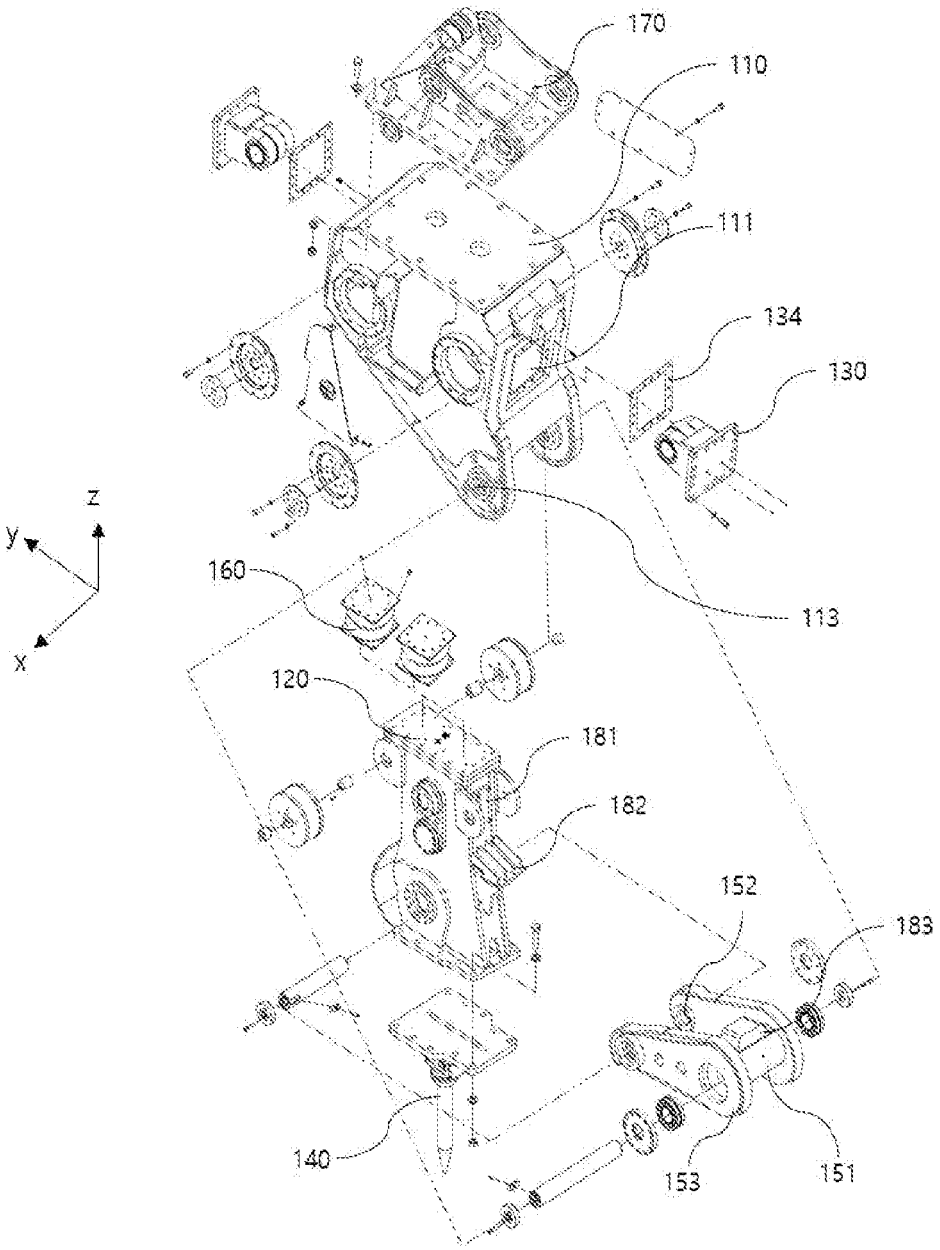
FIG. 2 is an exploded perspective view of FIG. 1.
Figure 3:
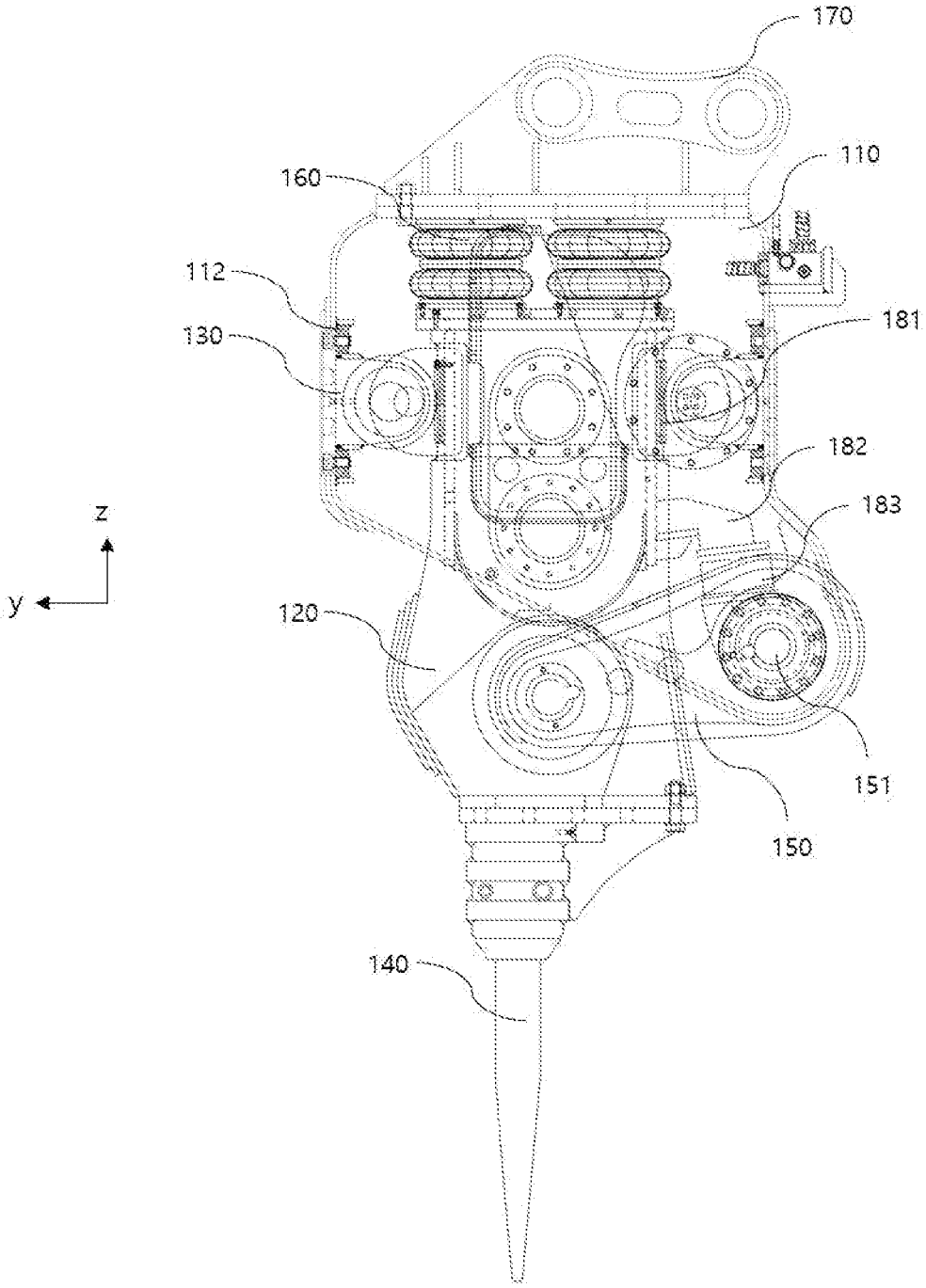
FIG. 3 is a view illustrating a state in which an external body in FIG. 1 is transparently processed so that the inside of the external body is seen.

The guide roller 130 absorbs the vibration of the vibratory body 120 by using the roller member 133 rotating while contacting an outer surface of the vibratory body 120 and guides a moving path of the vibratory body 120 when the vibratory body 120 moves vertically. Referring to FIGS. 1 to 3, the guide roller 130 may contact the housing of the vibratory body 120 at front and rear sides (a Y-axis direction and a direction opposite thereto) of the vibratory body 120.

The guide roller 130 includes a fixing plate 131 disposed on the external body 110, a fixing member 132 fixing the fixing plate 131 to the external body 110, the roller member 133 inserted into the external body 110 to guide the vertical movement of the vibratory body 120, and a shock absorbing member 134 disposed between the fixing plate 131 and the external body 110. Also, the guide roller 130 may further include a roller support member 135 supporting the roller member 133 so that the roller member 133 rotates along a predetermined axis.

The fixing plate 131 is a portion by which the guide roller 130 is fixed to the external body 110. The fixing plate 131 include a portion overlapping an outer surface of the edge of the insertion hole 111 of the external body 110 and holes arranged along the outer surface of the edge of the insertion hole 111. The holes are disposed at positions corresponding to the insert holes of the external body 110. Through this, as the fixing plate 131 contacts the outer surface of the external body 110, and the bolt 132 is inserted into the insert hole of the external body 110 through the hole, the guide roller 130 may be fixed to the external body 110. The fixing plate 131 may be made of metal or alloy. However, the embodiment of the present invention is not limited thereto.

The fixing member 132 performs a function of fixing the guide roller 130 to the external body 110. The fixing member 132 may include a coil 132*b* inserted into a portion of each of a hole of the shock absorbing member 134 and the insert hole of the external body 110 and the bolt 132*a* inserted along a thread formed by the coil 132*b*.

The coil 132*b* is disposed between a thread of the insert hole of the external body 110 and a thread of the bolt 132*a* to perform a function of protecting the thread of the insert hole and the thread of the bolt 132*a* from a vibration or a shock. The outside (based on a rotation axis of the coil) of the coil 132*b* may be rotated and inserted along the thread of the insert hole in correspondence to the thread. Also, the inside (based on the rotation axis of the coil) of the coil 132*b* may correspond to the thread of the bolt 132*a*, and the bolt 132 may be rotated and inserted thereto. The coil 132*b* may have one end disposed at an inlet of the insert hole and the other end disposed at a depth corresponding to ⅓ to ½ of an entire depth of the insert hole. Through this, although the guide roller 130 vibrates with respect to the external body 110 caused by the vibration of the vibratory body 120, the bolt 132*a* may move slightly around the coil 132*b* to prevent the bolt 132 from being damaged. Also, since a contact area in which the bolt 132*a* contacts the coil 132*b* increases by the coil 132*b*, a pressure or a shock applied to the thread of the bolt 132*a* may be distributed to prevent the bolt 132*a* from being damaged. Although the coil 132*b* may be made of metal or alloy or made of the same material as the external body 110, preferably, the coil 132*b* may be made of a material having rigidity greater than that of the external body 110. A wire of the coil 132*b* may have a diameter of several hundreds μm to several mm.

The bolt 132*a* is inserted into the insert hole and fixes the guide roller 130 to external body 110. The bolt 132*a* may be inserted into the insert hole through a hole of the fixing plate 131 and a hole of the shock absorbing member 134 and contact the coil 132*b* disposed in the insert hole. However, the embodiment of the present invention is not limited to the size and shape of the bolt 132*a*.

The shock absorbing member 134 is disposed between the fixing plate 131 and the external body 110. The shock absorbing member 134 dampens a vibration applied to the roller member 133 to prevent from the bolt 132*a* from being damaged. Also, the shock absorbing member 134 may perform a function of distributing a pressure caused by a head of the bolt 132*a* to protect a surface of the external body 110 and the insert hole.

The shock absorbing member 134 may have a hollow circular or polygonal ring shape. The roller member 133 may be inserted into the hollow portion, and the ring portion may have one surface contacting a portion overlapping the outer surface of the edge of the insertion hole 111 of the external body 110 in the fixing plate 131 and the other surface contacting the outer surface of the edge of the insertion hole 111 of the external body 110.

The shock absorbing member 134 includes a hole through which the fixing member 132 passes. The hole is disposed at a position corresponding to the insert hole of the external body 110. As described above, the bolt 132*a* of the fixing member 132 passes through the hole of the fixing plate 131 and inserted into the insert hole of the external body 110. Thus, a portion (a head portion) in which the bolt 132*a* presses the fixing plate 131 and a portion (a portion contacting the coil 132*b* in the thread) in which the bolt 132*a* receives a vibration of the external body 110 may be spaced a predetermined distance from each other. Through this, even when the guide roller 130 receives a shock caused by the vibration of the vibratory body 120, the bolt 132 may move slightly to prevent the bolt 132*a* from being damaged. Also, since the shock absorbing member 134 itself absorbs a vibration, the blot 132*a* may be prevented from being damaged.

The shock absorbing member 134 may be made of metal or alloy or made of the same material as the external body 110. The shock absorbing member 134 may have a thickness of several mm.

Figure 4:
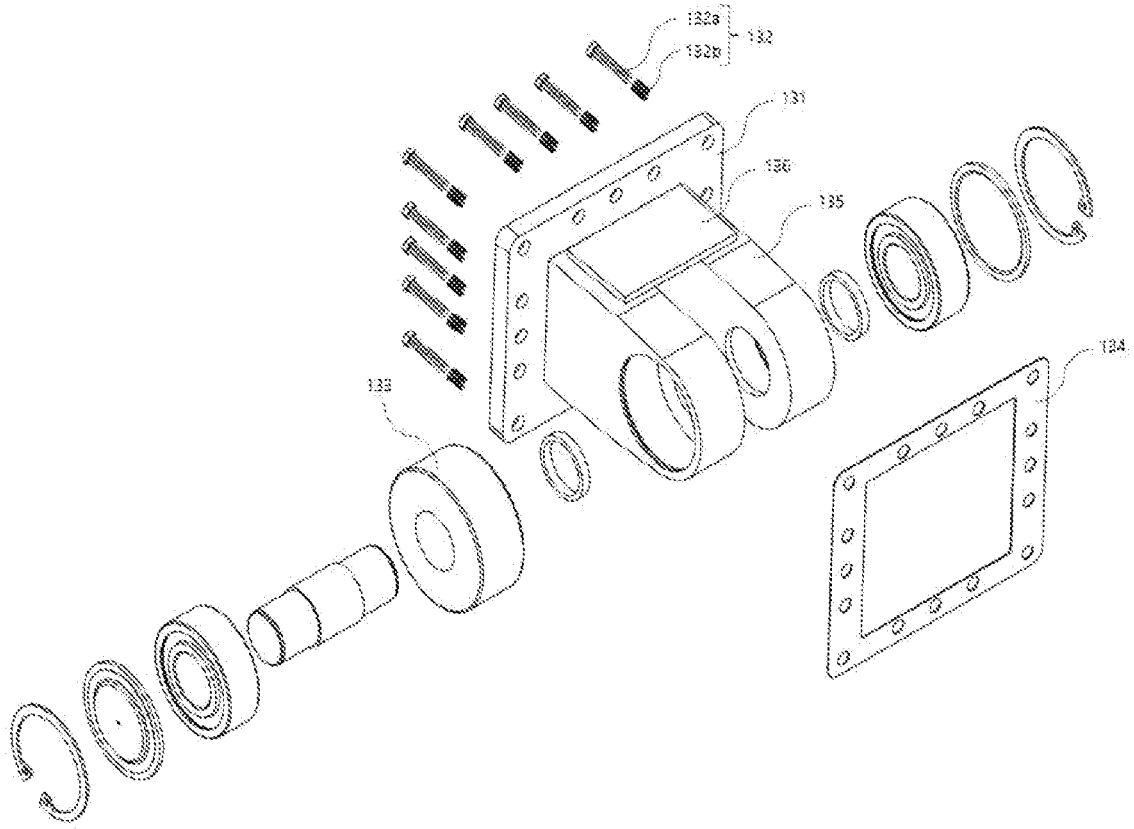
FIG. 4 is an exploded perspective view illustrating a guide roller.
Figure 5:
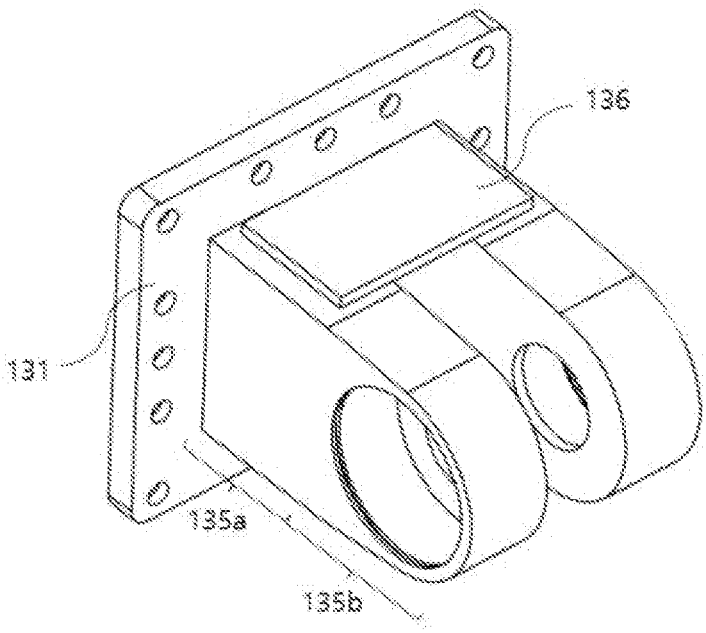
FIG. 5 is a view illustrating some components of the guide roller.

The roller support member 135 performs a function of supporting the roller member 133 to rotate. The roller support member 135 may include a hole through which a shaft of the roller member 133 passes, and the hole may be provided in plurality. Referring to FIGS. 2, 4, and 5, two roller support members 135 are disposed. The roller support member 135 may include the first member 135*a* including a hole for supporting the roller member 133 and a second member 135*b* having one end connected to the first member 135*a* and the other end connected to the fixing member 132. The second member 135*b* may be disposed between the support structures 112 disposed on the upper and lower portions of the insertion hole 111 of the external body 110 and allow the guide roller 130 to be tightly fixed to the external body 110. Through this, a feature, in which the guide roller 130 is separated from the external body 110 or the fixing member 132 of the guide roller 130 is damaged, caused by the vibration generated when the vibratory body 120 operates may be prevented.

Also, the guide roller 130 may further include a connecting plate 136 connecting a plurality of the second members 135*b*. The connecting plate 136 may connect the second members 135*b* to sufficiently prevent the roller member 133 from being deformed or separated and be disposed between the support structures 112 of the external body 110 and the second members 135*b* to dampen the vibration of the external body 110.

Each of the roller support member 135 and the connecting plate 136 may be made of metal or alloy or made of the same material as the external body 110.

The roller member 133 may include a rotation shaft and various components such as a roller, a bush, and a bearing inserted to the rotation shaft to rotate. Although the roller member 133 may have a generally used structure to apply a roller in the corresponding field, the embodiment of the present invention is not limited thereto.

The tooth 140 transmits a vibration generated from the vibratory body 120 to an external object to be crushed, thereby crushing the external object. The tooth 140 may have an upper portion connected to the vibratory body 120. Although the tooth 140 may be a tooth that is generally used in the corresponding field, the embodiment of the present invention is not limited thereto.

The link member 150 connects the external body 110 and the vibratory body 120 so that the vibratory body 120 moves, and absorbs the vibration of the vibratory body 120. The link member 150 may be connected to the external body 110 and the vibratory body 120 through a link structure having a rotation shaft. Although the link member 150 may be a link member that is generally used in the corresponding field, the embodiment of the present invention is not limited thereto.

The link member 150 may include a first link shaft member 151 providing a shaft rotating with respect to the link hole 113 of the external body 110, a second link shaft member 152 providing a shaft rotating with respect to the hole of the vibratory body 120, and a link plate connecting the first link shaft member 151 and the second link shaft member 152.

The first link shaft member 151 may include a hole disposed at a position corresponding to the link hole 113, a shaft inserted into the hole and the link hole 113 to rotate, and a pipe connecting the holes and surrounding the shaft. Referring to FIG. 2, as both ends of the pipe of the first link shaft member 151 are connected to respective link plates 153, and the shaft is inserted into an inner hollow portion thereof, the vibratory body 120 may move vertically with respect to the external body 110. Also, the second stopper 183 is disposed on an upper portion of the pipe of the first link shaft member 151 and collides with the first stopper 182 disposed at one side of the vibratory body 120 to stably and effectively restrict a moving range of the vibratory body 120.

The second link shaft member 152 may include a hole disposed at a position corresponding to the hole of the vibratory body 120 and a shaft inserted into the hole and the hole of the vibratory body 120 to rotate. Referring to FIG. 2, the shaft of the second link shaft member 152 may pass through and be inserted into the hole of the second link shaft member 152 and the hole of the vibratory body 120.

The vibration-proof member 160 performs a function of absorbing the vibration generated from the vibratory body 120. The vibration-proof member 160 may be disposed in the accommodation part of the external body 110 and disposed between the inner surface of the external body 110 and the vibratory body 120. Referring to FIG. 2, the vibration-proof member 160 is disposed on the upper portion of the vibratory body 120. The vibration-proof member 160 may include elastic rubber or an elastic spring. Although the vibration-proof member 160 may be a vibration-proof member that is generally used in the corresponding field, the embodiment of the present invention is not limited thereto.

The upper fastening member 170 is a component connecting the vibratory ripper 100 to an external device. As the vibratory ripper 100 is connected to an external device such as an excavator through the upper fastening member 170, the vibratory ripper 100 may move to a crushing position and receive a power. Although the upper fastening member 170 may include a hole or a shaft and have a shape that is generally used in the corresponding field, the embodiment of the present invention is not limited thereto.

As the roller guide 181 provides a path for the vibratory body 120 to move vertically along the roller member 133, the roller guide 181 may allow the vibratory body 120 to move more stably along the roller member 133, prevent the roller member 133 from separating from the path, and prevent a side surface of the vibratory body 120 from being damaged by the roller member 133.

The roller guide 181 may be disposed between the vibratory body 120 and the roller member 133. The roller guide 181 may include a plate contacting the roller member 133 and a protruding part disposed on an edge of the plate in a vertical direction. The roller member 133 may move along a path defined by the protruding part in a state of contacting the plate with the protruding parts disposed at both sides thereof. Through this, the roller guide 181 may prevent the roller member 131 from being separated.

The first stopper 182 may be disposed on at least one side of the vibratory body 110 or a lower end of the roller guide 181. Referring to FIG. 3, the first stopper 182 may extend from one side surface of the vibratory body 120 in an outer direction (a direction opposite to the Y-axis) and have a '¬'-shape.

When the vibratory body 120 moves downward, the second stopper 183 moves to a position contacting the first stopper 181 and restricts a moving distance of the vibratory body 120. As described above, the second stopper 183 may be disposed on an upper portion of the link member 150, more particularly, an upper portion of the first link shaft member 151.

When the vibratory body 120 moves downward, the first stopper 182 may contact the second stopper 183 to prevent the vibratory body 120 from moving to a predetermined height or less. As described above, when the first stopper 182 collides with the second stopper 183, the vibratory body 120 may receive a force in Z-axis and Y-axis directions and apply a shock to the guide roller 130. According to the present invention, the guide roller 130 may be stably fixed to the external body 110 and dampen a shock through an organic combination of the fixing member 132, the shock absorbing member 134, the roller support member 135, the connecting plate 136, the roller guide 181 and the support structure 112.

The vibratory ripper according to the embodiment of the present invention may effectively absorb the vibration of the vibratory body and improve the durability.

Also, the present invention may provide the guide roller that stably supports the vertical movement of the vibratory body.

Also, the present invention may effectively absorb the shock transmitted to the guide roller to extend the lifespan of the product.

Also, the present invention may perform the maintenance of the guide roller.

Although the embodiments of the present invention have been described, it is understood that the present invention should not be limited to these embodiments but various changes and modifications can be made by one ordinary skilled in the art within the spirit and scope of the present invention as hereinafter claimed.

What is claimed is:

1. A vibratory ripper comprising:

an external body having an inner accommodation part and comprising at least one insertion hole defined at one side thereof;

a vibratory body accommodated in the accommodation part of the external body to form a vibration; and a guide roller disposed in the insertion hole to guide a vertical movement of the vibratory body, wherein the guide roller comprises:

a fixing plate disposed on the external body;

a fixing member configured to fix the fixing plate to the external body;

a roller member inserted into the external body to guide the vertical movement of the vibratory body; and a shock absorbing member disposed between the fixing plate and the external body, wherein the fixing member comprises:

a coil inserted into a portion of each of a hole of the shock absorbing member and an insert hole of the external body; and a bolt inserted along a thread formed by the coil.

2. The vibratory ripper of claim 1, wherein the external body comprises a support structure disposed on each of upper and lower portions of the insertion hole and extending to the inside of the external body, wherein the guide roller further comprises a fixing support member disposed between the roller member and the fixing plate and fixed to the support structure.

3. The vibratory ripper of claim 1, further comprising:

a link member configured to connect the external body and the vibratory body;

a roller guide disposed at one side of the vibratory body and configured to guide the vibratory body to move vertically along the roller member while contacting the roller member;

a first stopper disposed below the roller guide; and a second stopper configured to restrict a moving distance of the vibratory body while contacting the first stopper when the vibratory body moves downward.

4. The vibratory ripper of claim 3, wherein the external body comprises a link hole, the link member comprises a first link shaft member that rotates around the link hole, and the second stopper is disposed on the first link shaft member.

5. A vibratory ripper comprising:

an external body having an inner accommodation part and comprising at least one insertion hole defined at one side thereof;

a vibratory body accommodated in the accommodation part of the external body to form a vibration; and a guide roller disposed in the insertion hole to guide a vertical movement of the vibratory body, wherein the guide roller comprises:

a fixing plate disposed on the external body;

a fixing member configured to fix the fixing plate to the external body;

a roller member inserted into the external body to guide the vertical movement of the vibratory body; and a shock absorbing member disposed between the fixing plate and the external body, wherein the shock absorbing member comprises a hole through which the fixing member passes and dampens a vibration applied to a bolt of the fixing member, which is caused by a vibration of the roller member.

6. The vibratory ripper of claim 5, wherein the external body comprises a support structure disposed on each of upper and lower portions of the insertion hole and extending to the inside of the external body, wherein the guide roller further comprises a fixing support member disposed between the roller member and the fixing plate and fixed to the support structure.

7. The vibratory ripper of claim 5, further comprising:

a link member configured to connect the external body and the vibratory body;

a roller guide disposed at one side of the vibratory body and configured to guide the vibratory body to move vertically along the roller member while contacting the roller member;

a first stopper disposed below the roller guide; and a second stopper configured to restrict a moving distance of the vibratory body while contacting the first stopper when the vibratory body moves downward.

* * * * *